US006749084B2

(12) United States Patent
Thompson

(10) Patent No.: US 6,749,084 B2
(45) Date of Patent: Jun. 15, 2004

(54) PLATE SPRING FOR POP-UP SHEET MATERIAL DISPENSER

(75) Inventor: Craig D. Thompson, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/094,670

(22) Filed: Mar. 11, 2002

(65) Prior Publication Data

US 2003/0168468 A1 Sep. 11, 2003

(51) Int. Cl.[7] ..... B65H 1/08
(52) U.S. Cl. ..... 221/56; 221/58; 221/63
(58) Field of Search ..... 221/52, 56, 58, 221/63

(56) References Cited

U.S. PATENT DOCUMENTS

| | | | | |
|---|---|---|---|---|
| 2,634,855 A | | 4/1953 | Mandel | |
| 4,416,392 A | | 11/1983 | Smith | 221/45 |
| 4,586,631 A | | 5/1986 | Loder | 221/58 |
| 4,653,666 A | | 3/1987 | Mertens | 221/45 |
| 4,781,306 A | | 11/1988 | Smith | 221/33 |
| 4,796,781 A | | 1/1989 | Windorski et al. | 221/45 |
| 4,993,590 A | | 2/1991 | Windorski | 221/46 |
| 5,165,570 A | | 11/1992 | Windorski et al. | 221/46 |
| 5,197,631 A | * | 3/1993 | Mishima | 221/52 |
| 5,363,985 A | * | 11/1994 | Cornell | 221/46 |
| 5,671,866 A | | 9/1997 | Bodziak | 221/45 |
| 5,979,700 A | * | 11/1999 | Suess | 221/56 |
| 6,550,636 B2 | * | 4/2003 | Simpson | 221/59 |

* cited by examiner

*Primary Examiner*—David H. Bollinger
(74) *Attorney, Agent, or Firm*—Carolyn V. Peters; George W. Jonas

(57) ABSTRACT

A package for dispensing sheet material from a stack includes a novel biasing device for urging the stack of sheet material toward an opening in one side of the package. The biasing device is comprised of a flat sheet of material sized and shaped to be located within the package beneath the stack of sheet material. An elastomeric element having an unstressed length that is less than a diameter of the flat sheet of material is stressed and positioned between opposite edges of the flat sheet of material. As stress is relieved from the elastomeric element, the elastomeric element draws the opposite edges together and elevates a central portion of the sheet of material in the form of an arch to urge the stack toward the opening as the stack of sheet material is depleted.

14 Claims, 4 Drawing Sheets

PLATE SPRING FOR POP-UP SHEET MATERIAL DISPENSER

BACKGROUND OF THE INVENTION

The present invention relates to an improved package for dispensing individual sheets of material from a stack. In particular the present invention relates to an improvement in biasing devices for urging a stack of sheet material toward an opening of the package.

Packaging previously has been developed to hold a stack of sheet material and permit dispensing of individual sheets of the material one at a time. The packaging characteristics depend on the manner in which the stack of sheet material is formed. For example, where the successive sheets of material in a stack are connected to one another along alternating opposing edges by a peelable adhesive (e.g., in a Z-fold manner), packaging has included a six-sided container with an opening in one side for removing individual sheets from the stack. Successful single sheet dispensing from such package requires that the stack be urged toward the opening, even as the sheets in the stack are being depleted. Various ways of urging the stack toward the opening have been proposed.

In U.S. Pat. No. 4,586,631, which is owned by a common assignee with the present application, a piece of foam material is compressed and placed in the packaging behind the bottom of the stack. The foam material provides a force to urge the stack toward the opening as individual sheets are removed from the packaging.

In U.S. Pat. No. 4,653,666, also owned by a common assignee with the present invention, a spiral wire spring compressed and placed between the stack and the base of the packaging provides the force necessary to lift the stack as individual sheets are dispensed.

The present invention constitutes an improvement over prior biasing devices for dispensing individual sheets from a Z-folded stack of sheet material from a container.

BRIEF SUMMARY OF THE INVENTION

The present invention provides an improved means for biasing a stack of sheet material within a dispensing package, wherein the stack of sheet material comprises a plurality of vertically aligned sheets of material which are releasably adhered to each other along opposite edges of successive sheets by a narrow band of pressure-sensitive adhesive, and wherein the dispensing package comprises a bottom, side walls and a top, the top defining an opening that extends between opposing side walls. The inventive biasing device comprises a sheet of material sized to fit within the dispensing package between the stack of sheet material and the bottom of the dispensing package. An elastomeric element, having an unstressed length that is less than a length of one edge of the sheet of material, is positioned between opposing first and second edges of the sheet, and secured to opposing sections of the sheet. The elastomeric element thereby draws the first and second edges of the sheet toward one another and elevates a central portion of the sheet of material.

While the above-identified drawing figures set forth preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention. It should be specifically noted that the figures have not been drawn to scale as it has been necessary to enlarge certain portions for clarity.

DETAILED DESCRIPTION

The present invention is directed to an improved package for dispensing sheets of material which are joined together along one edge thereof such that the sheets are joined along alternately opposite edges of successive sheets in such a manner that they may be separated by a peeling force applied against the edge of the successive sheets. The sheets may be preferably adhered together by a narrow band of pressure-sensitive adhesive or by another substance which has greater shear strength than peel strength such that pulling on one sheet to draw the same through the opening of the dispenser will cause the next adjacent sheet to buckle and the adjacent end to be drawn from the stack through the exit opening with the dispensed sheet. The dispensed sheet then applies a peel force against the edges of the sheets to separate them.

Figure 1:
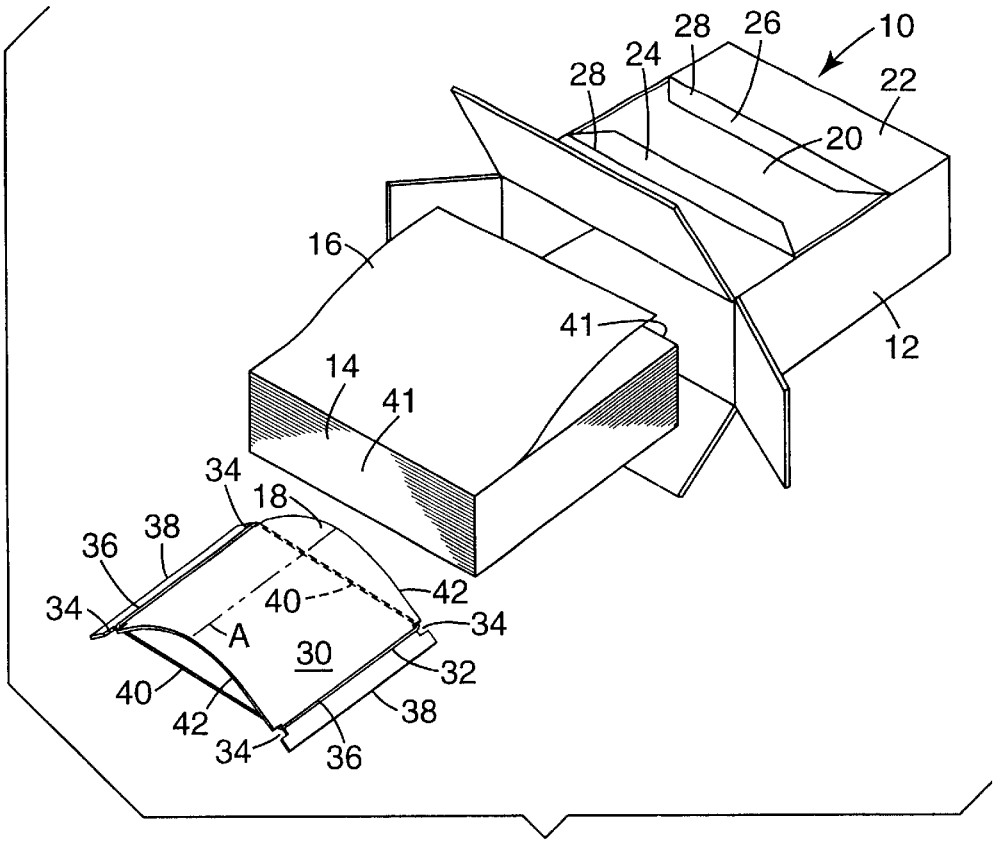
FIG. 1 is an exploded perspective view of the sheet dispenser package of the present invention.

FIG. 1 shows an exploded perspective view of the components of a package-dispenser 10 according to the present invention. The dispenser 10 comprises a box-like container 12 in which is placed a stack 14 of sheets 16 of a corresponding size and shape, and a biasing device 18. The container 12 includes an opening 20 in the top 22, through which individual sheets 16 can pass. Located on either side of opening 20 are flaps 24 and 26. Score lines 28 in the top 22 allow flaps 24 and 26 to bend somewhat to allow the top-most sheet 16 to project above the package.

Positioned within dispenser 10 beneath the stack 14 is one embodiment of an improved biasing device 18 for urging the stack 14 toward the top 22 as the sheets in the stack are removed. Biasing device 18 is comprised of a sheet 30 of polymeric material having a size and shape that generally corresponds to a footprint of the stack of material. As shown, sheet 30 is urged into a curved or arched state by means of an elastomeric band 32. Elastomeric band 32 has an unstressed circumference which is smaller than a circumference of sheet 30. By stressing elastomeric band 32 and positioning it within recesses 34 near each corner of sheet 30, sheet 30 assumes the curved or arched state. The distance between recesses 34 along edges 38 is selected to be less than the distance between recesses 34 along edges 42 to ensure that sheet 30 curves toward stack 14. In the embodiment shown in FIG. 1, portions 36 of elastomeric band 32 serve to hold elastomeric band 32 relative to sheet 30. Portions 40 of elastomeric band locate below sheet 30. Owing to the smaller unstressed circumference of elastomeric band 32, portions 40 have an unstressed length that is less than the length of edges 42 of sheet 30. Thus, with band 32 positioned in recesses 34 opposing edges 38 of sheet 30 are drawn toward one another, causing sheet 30 to flex in an upward direction, as shown in FIG. 1. Sheet 30 is oriented between container 12 and stack 14 with the apex of sheet 30, shown by line A, extending between opposing edges 41 of stack 14.

Figure 2:
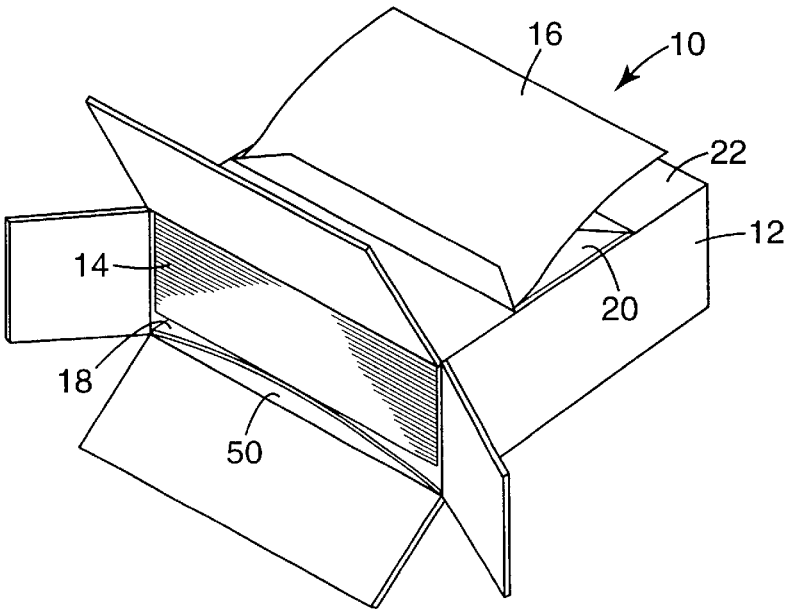
FIG. 2 is a perspective view of the assembled sheet dispenser package of FIG. 1.
Figure 2A:
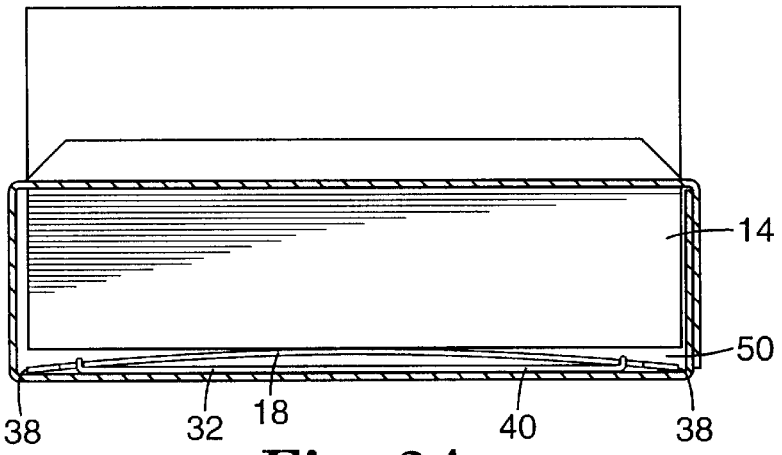
FIG. 2*a* is an end view of the assembled sheet dispenser package of FIG. 2.

FIGS. 2 and 2*a* show the package-dispenser 10 in an assembled condition, with stack 14 within container 12 and a top sheet 16 extending through opening 20 in top 22. Biasing device 18 is positioned between the base of container 12 and stack 14 to provide an upward force to stack 14 and thereby keep stack 14 in contact with the inner surface of top 22 of container 12. When stack 14 is at its initial size, stack 14 consumes a substantial amount of internal space of container 12, leaving only a small initial gap 50 between the base of container 12 and the bottom of stack 14. Biasing device 18 assumes a low initial profile to fill gap 50 by flattening sheet 30 and thereby stressing portions 40 of elastomeric band 32.

Figure 3:
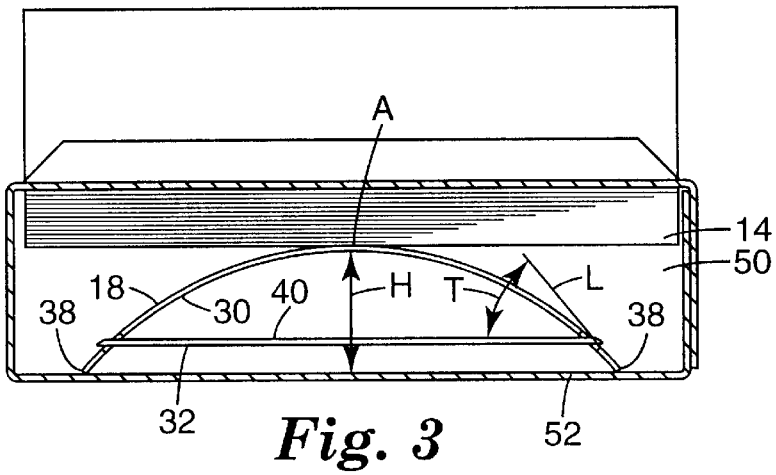
FIG. 3 is a cross-sectional view of the assembled sheet dispenser package of FIG. 2 with a partially depleted stack of sheet material.

FIG. 3 is a cross-sectional view of package-dispenser 10, to show the operation of biasing device 18 as sheets are depleted from the stack 14. As shown in FIG. 3, the stress on portions 40 of elastomeric band 32 is gradually relieved as gap 50 increases due to depletion of sheets from stack 14. As gap 50 increases, portions 40 of elastomeric band 32 contract and draw opposing edges 38 of sheet 30 toward one another thereby increasing the vertical distance H between the apex A of sheet 30 and base 52 of container 12.

In one exemplary embodiment, sheet 30 is comprised of a flexible polymeric material, such as polypropylene or polyethylene, having a thickness of about 0.020 inches. A sheet of such material formed in a 3 inch square and utilizing a rubber band having a lay flat length of 3.5 inches positioned on the sheet as previously described assumes a flat profile of about 0.0625 inches when sheet 30 is flattened and portions 40 of elastomeric band 32 are stressed. In other words, the distance between apex A of sheet 30 and base 52 of container 12 is about one sixteenth of an inch. With respect to the exemplary embodiment, when portions 40 of elastomeric band 32 are fully contracted, the apex A of sheet 30 is approximately 0.94 inches from a plane defined by edges 38 of sheet 30. To provide adequate force on stack 14, the maximum height of apex A is chosen to be greater than the distance from base 52 to top 22. A preferred material for elastomeric band 32 is a thermoplastic rubber, such as Ethylene Propylene Diene Monomer (EPDM).

Figure 4:
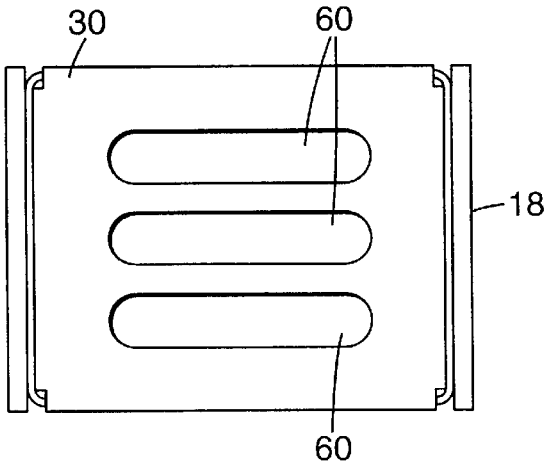
FIG. 4 is a top view of a first alternative embodiment of the biasing device of FIGS. 1–3 of the present invention.
Figure 5:
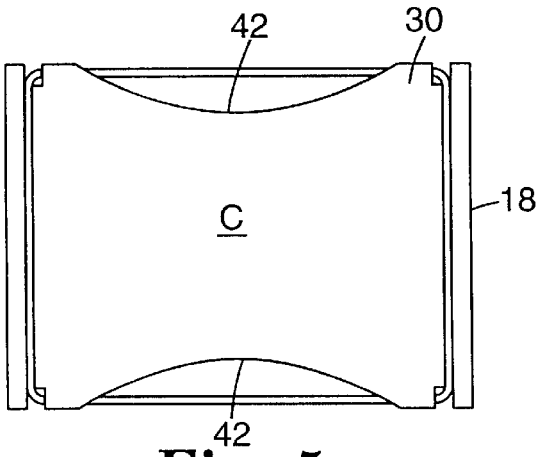
FIG. 5 is a top view of a second alternative embodiment of the biasing device of FIGS. 1–3 of the present invention.

FIGS. 4 and 5 are top views of alternative embodiments of biasing device 18. To increase flexibility and biasing force, sheet 30 can be formed with a pattern of slots or holes 60, as shown in FIG. 4. By forming sheet 30 in this manner, the amount of material needed to form sheet 30 is reduced. As shown in FIG. 5, alternatively edges 38 can be formed to curve toward the center C of sheet 30, thus reducing the width of sheet 30 and giving sheet 30 an hourglass-like shape. Other patterns for sheet 30 will be readily apparent to those of skill in the art.

The biasing device 18 of the present invention provides a unique benefit of a nearly constant normal force created over about 0.40 inches of travel (i.e., the value of H as shown in FIG. 3). This is the result of the plate geometry and the opposing forces from the elastomeric band and the plate bending force. The elastomeric force is greatest when sheet 30 is nearly flat whereas the bending force from sheet 30 is near its minimum. This force combination along with a small transmission angle (defined in FIG. 3 by elastomeric band portion 40 and an imaginary tangent line L at recess 34 of sheet 30) results in a reduced normal force. As biasing device 18 is allowed to relax (i.e., the number of sheets in the stack decreases) the elastomeric force decreases, the bending force increases and the transmission angle increases with a net result of a nearly constant normal force. The force profile can easily be adjusted by changing properties of sheet 30. Using a more flexible material increases the normal force but also changes the force curve from a constant to a decreasing profile. The flexibility of sheet 30 can also be varied by changing the thickness, material, or by adding flutes in the bending direction. The elastomeric force of portions 40 of band 32 can be adjusted by varying the length, width or thickness of the band, or by varying the material forming band 32. In addition, an individual section of elastomeric material can be utilized to form section 40 in lieu of a band of elastomeric material. Such an individual section of elastomeric material will of course have an unstressed length less than that of one of edges 42 of sheet 30 and will be connected to sheet 30 between opposing edges 38. The proposed biasing device 18 is a simple, dependable, low cost method for creating normal forces for urging a stack of sheet material toward the top of a dispensing container.

Figure 6:
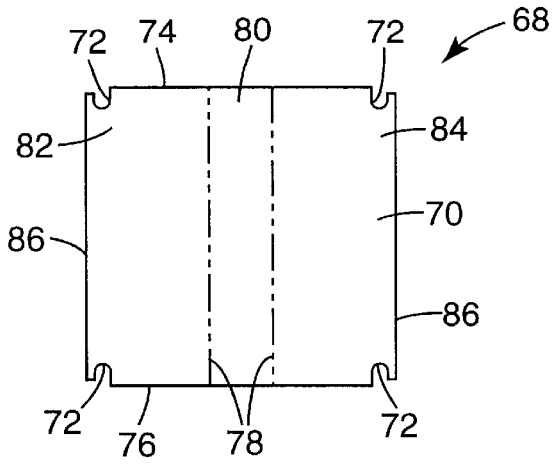
FIG. 6 is a top view of a third embodiment of a biasing device for the sheet dispenser package of the present invention.

FIG. 6 shows a top view of yet another embodiment of a biasing device of the present invention. As shown in FIG. 6, a biasing device 68 is formed from a sheet 70 of a fibrous material, such as a single side or double side clay coated card stock material, in a size and shape generally corresponding to biasing device 18 shown in FIG. 1. Sheet 70 includes recesses 72 near each corner of sheet 70 along opposing edges 74 and 76 of sheet 70. Recesses 72 aid in retaining an elastomeric band (shown in FIG. 7) in the manner described relative to biasing device 18. A pair of centrally located and spaced fold lines 78 are provided in sheet 70 to form a central section 80 and a pair of flanking sections 82 and 84. In one exemplary embodiment, sheet 70 is a 3 inch square of card stock material with fold lines 78 spaced approximately 1.125 inches from outer edges 86. Fold lines 78 are oriented in a direction corresponding to the fiber direction of the card stock material forming sheet 70. Fold lines allow sections 82 and 84 to bend at an angle relative to top 80.

Figure 7:
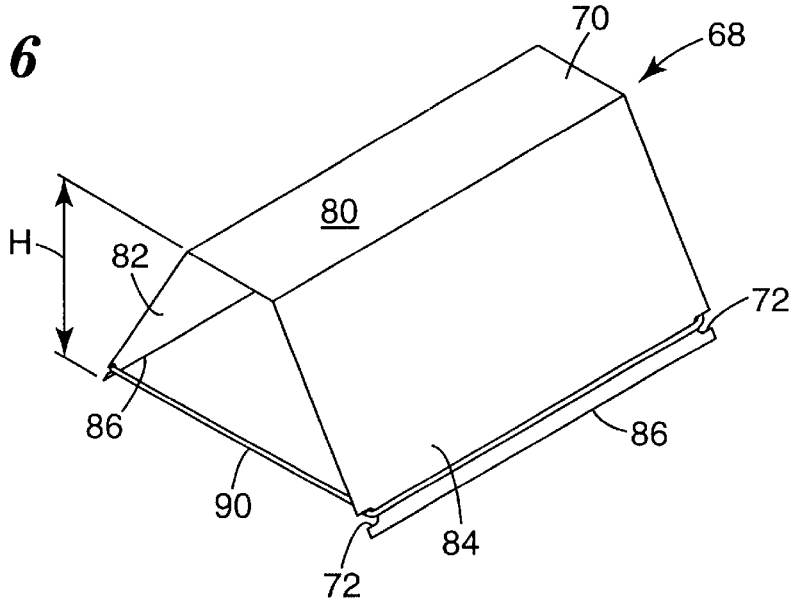
FIG. 7 is a perspective view of the biasing device of FIG. 6 assembled with an elastomeric band.
Figure 7A:
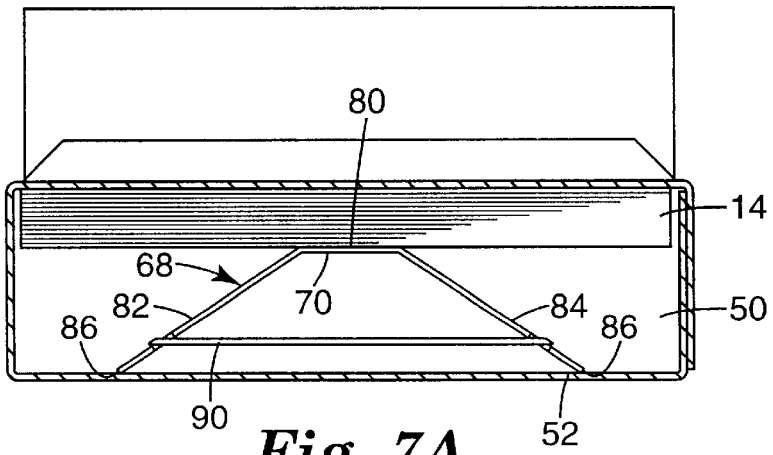
FIG. 7*a* is a cross-sectional view of an assembled sheet dispenser package with the biasing device of FIG. 7.

FIG. 7 shows a perspective view of sheet 70 with an elastomeric band 90 positioned in recesses 72. Elastomeric band 90 has an unstressed circumference less than the circumference of sheet 70. As a result, when elastomeric band 90 is positioned in recesses 72 in the manner previously described, sections 82 and 84 of sheet 70 are drawn inward and thereby increase the distance H between section 80 and a horizontal plane defined by opposing edges 86. Elastomeric band 90 can be stressed and sheet 70 can be flattened to assume a low profile and oriented for insertion into a container beneath a stack of sheet material, in the manner described relative to biasing device 18 of FIG. 2. As shown in FIG. 7*a*, as the stack of sheet material is depleted, elastomeric band 90 contracts to elevate section 80 above the base of the container and thereby urge the remaining sheets in the stack toward the top of the container. A biasing device 68 formed in the manner described provides yet another alternative, low cost means of reliably biasing a stack of sheet material in a dispenser-container. While a pair of fold lines 78 are disclosed to form sheet 70, an alternative embodiment can include a single centrally located fold line that bisects sheet 70 into two equal halves.

Figure 8:
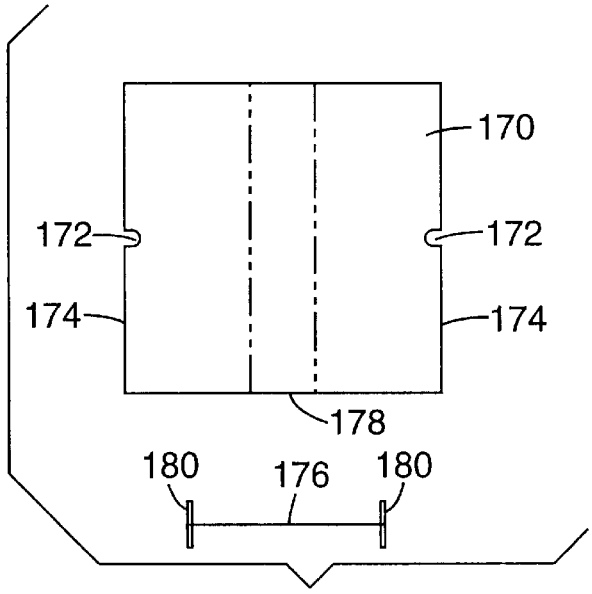
FIG. 8 is a top view of a fourth embodiment of a biasing device for the sheet dispenser package of the present invention.

FIG. 8 is a top view of another embodiment of the present invention to demonstrate an alternative manner of urging a sheet of material into an arched biasing device. In particular, the biasing device of FIG. 8 is comprised of a sheet 170 which is configured similarly to sheet 70 of FIG. 6. Unlike the embodiment of FIG. 6, however, sheet 170 employs a pair of recesses 172 associated with opposing outer edges 174. Recesses 172 serve to retain elastomeric element 176 in a manner to be described. As shown in FIG. 8, elastomeric element 176 has an unstressed length that is less than the length of edge 178 of sheet 170. Fixed at opposite ends of elastomeric element 176 are retaining pins 180.

Figure 9:
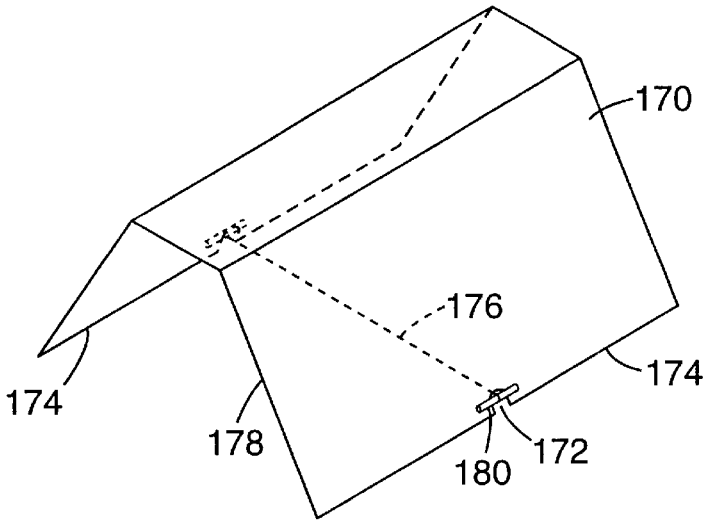
FIG. 9 is a perspective view of the biasing device of FIG. 8 in an assembled condition.
Figure 10:
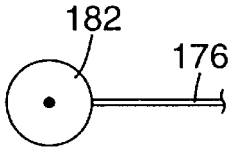
FIG. 10 is an enlarged end view of an alternative embodiment of the elastomeric element used with the biasing device of FIGS. 8–9.

FIG. 9 is a perspective view of the biasing device of FIG. 8 with elastomeric element 176 connected to sheet 170. As shown in FIG. 9, pins 180 of elastomeric element 176 are positioned in the respective recesses 172 of sheet 170. Pins 180 have a length greater than the gap forming recesses 172, and accordingly elastomeric element 176 is retained between opposing edges 174. Pins 180 may also be substituted by discs 182, as shown in the enlarged end view of elastomeric element 176 in FIG. 10. Pins 180 and/or discs 182 may be formed from a metal or any material with sufficient rigidity to hold elastomeric element 176 relative to opposite portions of sheet 170. Because elastomeric element 176 has an unstressed length less than the length of edge 178, sheet 170 is urged into an arched shape. The biasing device defined by Sheet 170 and elastomeric element 176 functions in the manner described relative to FIGS. 6–7A, albeit with only a single section of an elastomeric element.

Although the present invention has been described with reference to preferred embodiments, workers skilled in the art will recognize that changes may be made in form and detail without departing from the spirit and scope of the invention. For example, in lieu of recesses 34, 72 or 172, other means of securing an elastomeric band 32, or individual section(s) of elastomeric material, to a sheet of material are contemplated. Recesses may be replaced by small protrusions or extensions of the respective sheet edges. Also, recesses or the aforementioned protrusions can be spaced relative to the corners of the sheet of material. Consistent with the present teachings, other means of urging the sheet into a curved or arched state, such as forming the sheet of material with a shape memory material, will be evident to those skilled in the art.

What is claimed is:

1. A dispenser package for sheet material comprising:

a container having a bottom, side walls and a top, the top defining an opening extending between opposing side walls;

a stack of sheet material positioned within the container, the stack comprised of a plurality of vertically aligned sheets of material which are releasably adhered to each other along opposite edges of successive sheets by a narrow band of pressure-sensitive adhesive, a first sheet of material capable of passing through the opening in the top of the container;

a sheet of generally flat flexible material disposed between the bottom of the container and the stack of sheet material, having a top surface in contact with the stack of sheet material, a bottom surface, a first pair of opposing edges and a second pair of opposing edges; and an elastomeric element engaged with the sheet of flexible material so as to bias the flexible material into a curved state, the elastomeric element having an unstressed length that is less than a length of one edge of the first pair of opposing edges of the sheet of flexible material.

2. The dispenser package of claim 1 wherein the elastomeric element comprises first and second portions of an elastomeric material, the first and second portions having an unstressed length less than a length of one edge of the first pair of edges.

3. The dispenser package of claim 1 wherein the sheet of flexible material further comprises:

a pair of creases, the pair of creases spaced from and generally parallel to the first pair of opposing edges; and wherein the elastomeric element engages the sheet of flexible material to bend the sheet of flexible material along the pair of creases, urging the top of the flexible sheet towards the top of the container.

4. The dispenser package of claim 1 wherein the elastomeric element comprises first and second portions of an elastomeric material, the first and second portions having an unstressed length less than a length of one edge of the first pair of edges.

5. The dispenser package of claim 1, wherein the elastomeric element is in form of an elastic band.

6. The dispenser package of claim 5, wherein the elastic band has an unstressed circumference that is less than the circumference of the sheet of flexible material.

7. In a dispenser package for sheet material comprising a container having a base, a cover and side walls which define an interior space, the interior space containing a stack of sheet material, the stack comprised of a plurality of vertically aligned sheets of material which are releasably adhered to each other along opposite edges of successive sheets by a narrow band of pressure-sensitive adhesive, an opening in the cover to permit removal of individual sheets from the stack, and means for biasing the stack of sheet material toward the cover, the improvement comprising:

a flexible plate sized to fit in the interior space of the container between the stack of sheet material and the base of the container, the flexible plate having a top surface, a bottom surface, first and second opposing edges, third and fourth opposing edges, and a circumference;

an elastomeric band having an unstressed circumference that is smaller than the circumference of the flexible plate, the elastomeric band being positioned over the top surface of the flexible plate such that first and second portions of the elastomeric band are near the first and second opposing edges of the flexible plate, and third and fourth portions of the elastomeric band are positioned below the bottom surface of the flexible plate near the third and fourth opposing edges, the third and fourth portions of the elastomeric band having an unstressed length less than a length of the third and fourth edges of the flexible plate.

8. A dispenser package for sheet material comprising:

a container having a bottom, side walls and a top, the top defining an opening extending between opposing side walls;

a stack of sheet material positioned within the container, the stack comprised of a plurality of vertically aligned sheets of material which are releasably adhered to each other along opposite edges of successive sheets by a narrow band of pressure-sensitive adhesive, a first sheet of material capable of passing through the opening in the top of the container;

a flexible plate sized to fit within the dispensing package between the stack of sheet material and the bottom of the dispensing package, the plate having a top surface, a bottom surface, opposing first and second edges, opposing third and fourth edges, and a circumference; and an elastomeric band having first and second portions, the first and second portions positioned between the first and second edges of the plate and secured to opposite sections of the plate, each portion having an unstressed length that is less than a length of one of the third and fourth edges of the plate, the elastomeric member thereby drawing the first and second edges of the sheet toward one another.

9. The device of claim 8 wherein the plate comprises a first pair of spaced recesses associated with the third edge and a second pair of spaced recesses associated with the fourth edge, and wherein the band of elastomeric material is positioned in the first and second pair of recesses.

10. The device of claim 8 wherein the plate is a polymer material.

11. The device of claim 8 wherein the first and second edges of the plate generally are parallel to one another, and wherein the third and fourth edges are formed to define a radially tapered width of the plate.

12. The device of claim 8 wherein the plate is formed to define one or more openings through the sheet, the openings generally being spaced from the first, second, third and fourth edges.

13. The device of claim 8 wherein the plate is a card stock material.

14. The device of claim 8 wherein the plate includes at least one crease, the at least one crease generally being parallel to and spaced from the first and second edges.

* * * * *

UNITED STATES PATENT AND TRADEMARK OFFICE

CERTIFICATE OF CORRECTION

PATENT NO. : 6,749,084 B2
DATED : June 15, 2004
INVENTOR(S) : Thompson, Craig D.

It is certified that error appears in the above-identified patent and that said Letters Patent is hereby corrected as shown below:

Column 8,
Line 1, delete the word "sheet" and insert in place thereof -- plate --.

Signed and Sealed this

Sixteenth Day of November, 2004

JON W. DUDAS
*Director of the United States Patent and Trademark Office*